US005564990A

United States Patent [19]

Weeks

[11] Patent Number: 5,564,990

[45] Date of Patent: Oct. 15, 1996

[54] PUTTER-TO-BALL AND GOLFER-TO-PUTTER ALIGNMENT USING A CLUB SHAFT

[76] Inventor: James R. Weeks, 74-860 Fairway Dr., Palm Desert, Calif. 92260

[21] Appl. No.: 644,736

[22] Filed: May 10, 1996

Related U.S. Application Data

[63] Continuation of Ser. No. 408,636, Mar. 22, 1995, abandoned.

[51] Int. Cl.[6] ..... A63B 69/36

[52] U.S. Cl. ..... 473/251; 473/252

[58] Field of Search ..... 473/251, 252, 473/253, 254, 255, 249, 242, 266

[56] References Cited

U.S. PATENT DOCUMENTS

| | | | |
|---|---|---|---|
| 786,268 | 4/1905 | Corey et al. | 273/164.1 |
| 1,526,951 | 2/1925 | Beaumont | 273/163 R |
| 3,486,755 | 12/1969 | Hodge | 273/164.1 |
| 4,077,633 | 3/1978 | Studen | 273/164.1 |
| 4,722,528 | 2/1988 | Tsao | 273/164.1 |
| 5,248,145 | 9/1993 | Brown | 273/164.1 |

FOREIGN PATENT DOCUMENTS

| | | | |
|---|---|---|---|
| 2017247 | 10/1992 | WIPO | 273/163 R |

OTHER PUBLICATIONS

Titleist, *Golf World*, "Dead Center", Jun. 1986, p. 17.

*Primary Examiner*—Steven Wong
*Attorney, Agent, or Firm*—Terry McHugh

[57] ABSTRACT

A golf putter includes a head having a heel portion on which alignment markings are formed in order to allow a golfer to use a club shaft in a manner to properly align the putter head relative to an intended path of ball travel and to align the golfer's head relative to the ball. The alignment markings include first and second longitudinal markings that are parallel to a striking face of the putter head. At least the outer edges of the first and second markings are spaced apart by a distance greater than the diameter of the club shaft, so that when the putter is perpendicular to the intended path and the golfer's head is directly over the ball, both outer edges are visible and extend parallel to the shaft. Preferably, the shaft is at an acute angle to the heel portion and extends in a direction away from a toe portion of the putter head. The alignment markings preferably include a center marking that is screened from the view of a properly positioned golfer. The center marking is between the first and second longitudinal markings. The center marking operates as an indicator of improper alignment, since the center marking is visible only if the putter head or the golfer's head is in a position other than that required for a technically correct putt.

15 Claims, 2 Drawing Sheets

PUTTER-TO-BALL AND GOLFER-TO-PUTTER ALIGNMENT USING A CLUB SHAFT

This application is a continuation of application Ser. No. 08/408,636 filed on Mar. 22, 1995 now abandoned.

TECHNICAL FIELD

The invention relates generally to the game of golf and more particularly to a golf putter having an alignment arrangement.

BACKGROUND ART

There are a number of aspects to the game of golf. While it is not always fully appreciated by the casual golfer, putting plays at least as an important role in a successful round of golf as any other component of the game. In executing a technically proper putt, a golf putter must be properly positioned relative to a ball and to an intended line of putt. A putter has a striking face which should be aligned perpendicularly to the desired path of ball travel. When putting on a flat green, if the heel of the putter is closer to the golf hole than the toe of the putter, the ball will travel to the right of the golf hole for a right-handed golfer. On the other hand, the ball will travel to the left of the hole if the toe is positioned even slightly closer to the hole than the heel of the putter.

It is known to incorporate hole alignment lines on the top surface of the putter in order to aid a golfer in positioning the striking face of the putter relative to the intended path of the ball. Typically, a hole alignment line is perpendicular to the striking face and is positioned at the desired area of putter-to-ball impact. Some putters are designed to stand alone, allowing a golfer to position the club adjacent to the ball and then walk behind the club to use the hole alignment lines as sights.

In addition to the proper positioning of the putter to the ball and the intended path, the position of the golfer relative to the ball is an important consideration of proper golf techniques. The head of the golfer should be directly over the ball, so that when the ball is addressed by the striking surface of the putter, the golfer's hands are in the proper position for controlling the impact.

Regular practice will improve many aspects of the golf game. Practice develops muscle memory, so that the proper techniques are more likely to be followed when a game is played. However, putter-to-ball alignment and head-to-hands-to-ball alignment are perfected only upon development of a trained eye. Even highly skilled golfers have been shown to find this second alignment, i.e. golfer-to-ball alignment, difficult to maintain over time.

An object of the invention is to provide a golf putter that can be used as an indication of when proper alignments have been achieved for stroking a golf ball.

SUMMARY OF THE INVENTION

The above object has been met by a golf putter that uses a club shaft to facilitate proper alignment of a putter head and a golfer's head relative to a ball and a desired path of ball travel. In effect, the club shaft is used as part of a "sighting" arrangement both to assist a golfer in lining up a putt and to correctly set up the golfer over a putt.

In the preferred embodiment, the golf putter includes a head having a heel portion and a toe portion. The heel portion has a generally planar upper surface on which alignment markings are formed. The alignment markings may be imprinted on the upper surface of the heel portion or may be formed into the upper surface.

The alignment markings on the heel portion include first and second markings that are parallel to each other and to a striking surface of the putter head. The outer edges of the first and second markings are spaced apart by a distance greater than the diameter of the club shaft, so that the outer edges are visible on opposed sides of the club shaft when the putter head and club shaft are viewed downwardly by a golfer properly positioned to strike a golf ball. In a preferred embodiment, the alignment markings also include a center marking between the first and second markings. The center marking will be screened from view by the properly positioned golfer, but will have a visible portion if the putter head is misaligned relative to the desired line of travel or if the player is improperly positioned relative to the ball. Typically, the club shaft is connected to the putter head so as to extend at an acute angle to the upper surface of the heel portion. Consequently, the lower region of the club shaft passes over the heel portion when the club is in an upright position. However, other shaft-to-head arrangements are possible.

The center marking may have a circular configuration, with a diameter that is equal to but preferably slightly less than the diameter of the club shaft at the region of the club shaft that is to screen the center marking. This portion of the club shaft may be considered as defining a reference dimension for determining the diameter of the center marking. It should be noted that the center marking may have a geometric shape other than a circle. In fact, a square or a rectangle may be a better identifier, since for a given amount of misalignment there will be a greater visible area of a center marking having such a configuration than would be visible for a center marking having a circular configuration. Providing the center marking with a distinctive color, e.g. red, would also increase visibility.

In operation, the "ground plumb" may be used to correctly align the head of the putter relative to an intended line of path, after the golfer has taken the appropriate stance. If the striking face is perpendicular to the intended path, the club shaft will be parallel to the first and second markings. In such case, the center marking will be screened from vision. On the other hand, if the toe portion or the heel portion of the putter head is somewhat forward of the other portion, the line of sight of the golfer will no longer be aligned in a manner that causes the center marking to be screened from view. If the forward side of the center marking is visible, a right-handed golfer will need to rotate the putter head in a clockwise direction. If the rearward portion of the center marking is visible, the same golfer will need to rotate the putter head in a counterclockwise direction until only the parallel first and second markings are visible and the club shaft is "sighted" with the parallel markings.

A properly positioned golfer has his or her eyes directly over the ball. If the golfer's head is rearward of the ball, the line of sight of the golfer will allow the center marking to be visible when the club is positioned adjacent to the ball. The rearward portion of the center marking will be visible, indicating that the golfer needs to move forwardly. On the other hand, the forward side of the center marking will be visible if the golfer's head is forward of the ball.

BEST MODE FOR CARRYING OUT THE INVENTION

Figure 1:
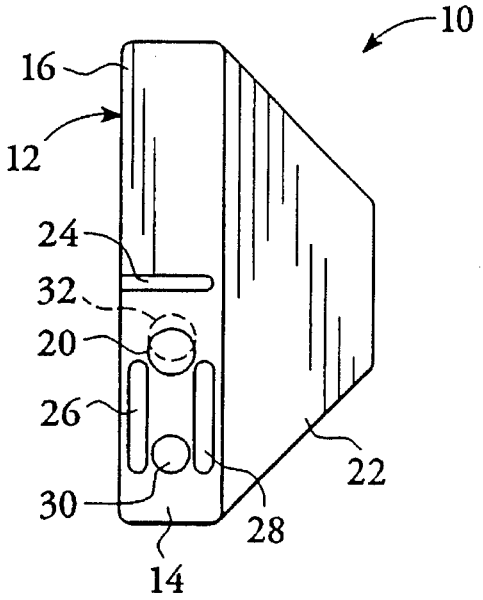
FIG. 1 is a top view of a putter head having alignment markings in accordance with the invention.
Figure 2:
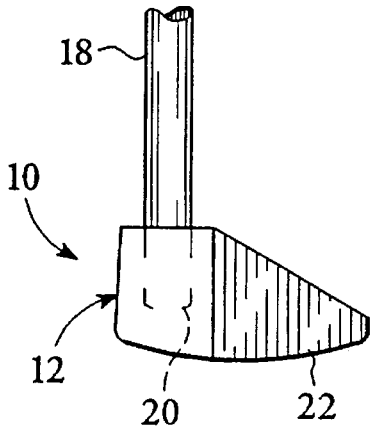
FIG. 2 is a view of the putter head of FIG. 1 from the heel of the head, with a club shaft extending upwardly.

With reference to FIGS. 1 and 2, a putter head 10 is shown as including a striking surface 12. The head is shown merely as an example, since the alignment strategy to be described below may be used in any other known golf putter.

The head 10 has a heel portion 14 and a toe portion 16. Conventionally, a club shaft 18 connects to the head, so that the intended area of impact of the striking surface 12 with a golf ball is on the same side of the shaft connection as the toe portion 16.

The club shaft 18 is received within an angled opening 20 in the putter head 10. For example, the opening 20 may be at a 13° angle to the vertical when the head is in an upright position.

At a rearward side of the putter head 10 is a downwardly inclined portion 22. This portion may be designed to achieve a certain "feel," but is not necessary to the putter or to the invention. Optionally, the upper surface of the inclined portion 22 may have backstroke alignment lines to aid a golfer. For example, the alignment lines may be at a 5° angle to a hole alignment line 24 that extends at a right angle to the striking surface 12. Conventionally, when a hole alignment line is included on the upper surface of the head of a putter, the line projects from the area of the striking face 12 at which contact is to be made with the golf ball.

At the heel portion 14 of the head 10 of the putter are first and second markings 26 and 28. The first and second markings are parallel to each other and to the striking face 12 of the head. Also shown in FIG. 1 is a center marking 30 between the first and second markings. The center marking is shown as having a circular configuration, but this is not critical. In fact, in many applications it is preferred to have a four-sided marking that increases the visibility of the edges of the center marking closest to the first and second markings.

Figure 4:
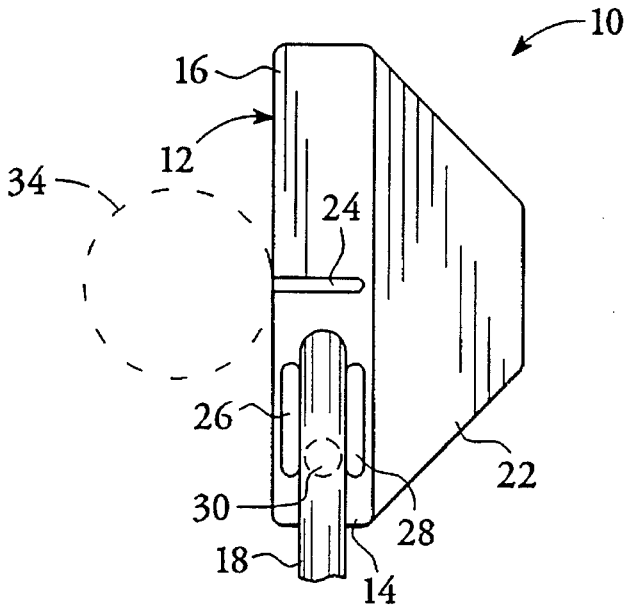
FIG. 4 is a top view of the golf putter of FIG. 3 from the line of sight of a properly positioned golfer.
Figure 3:
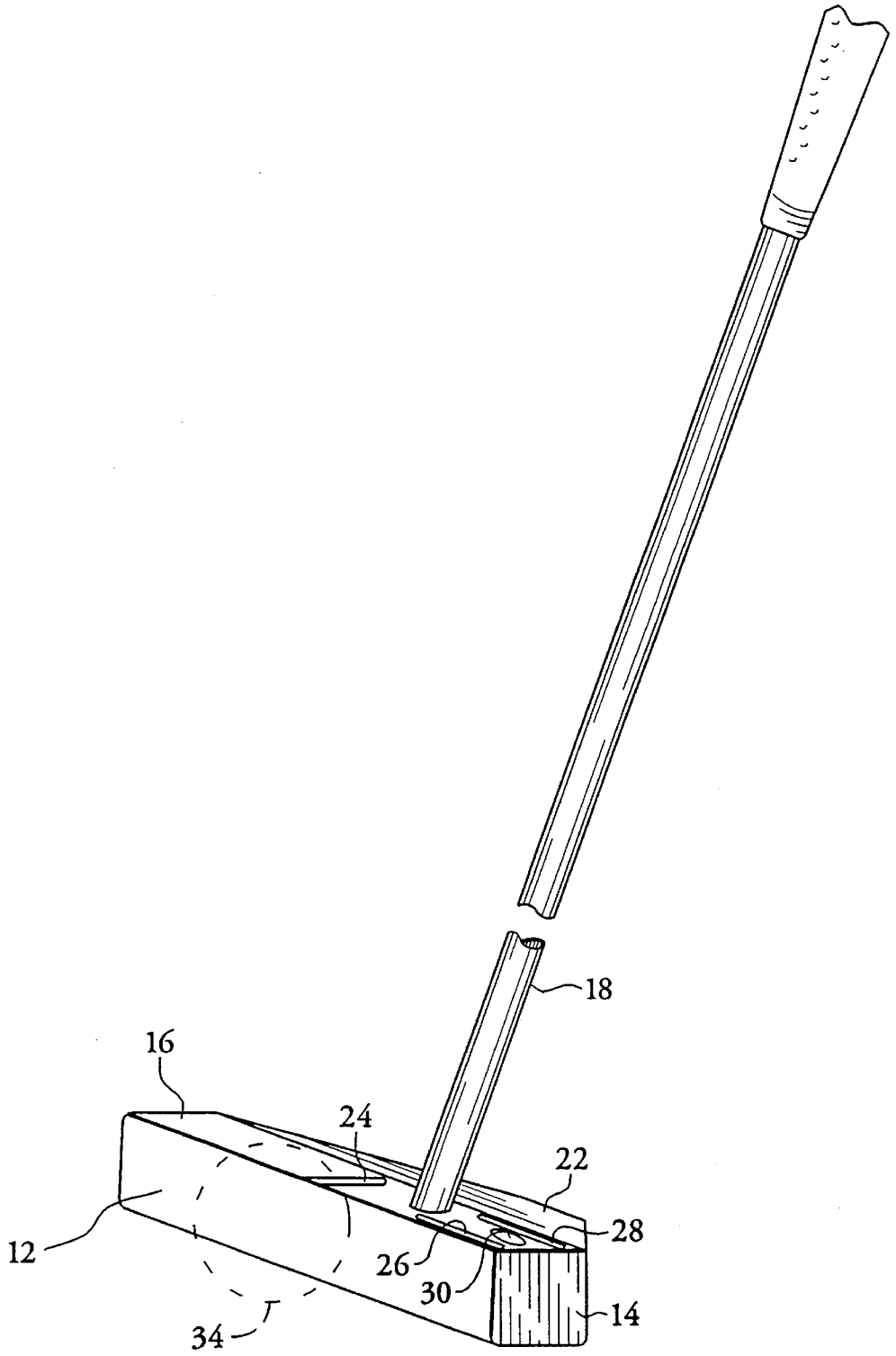
FIG. 3 is a perspective view of the golf putter of FIG. 2.

Referring now to FIGS. 1, 3 and 4, because the opening 20 that receives the club shaft 18 is angled, the lower portion of the club shaft will angle over the heel portion 14 of the putter head 10. In the embodiment described above, the opening 20 is at a 13° angle to the vertical, so that the club shaft is at a 77° angle relative to the upper surface of the heel portion 14. In FIG. 1, the bottom 32 of the opening 20 is shown in phantom. The angle is not critical to the invention, but in the preferred embodiment the shaft 18 is at an acute angle to the upper surface of the putter head and is directed away from the toe portion 16.

In FIG. 4, a golf ball 34 is shown as being positioned adjacent to the putter head 10. If struck correctly, the ball will travel in the direction corresponding to the longitudinal dimension of the hole alignment line 24. FIG. 4 is intended to be representative of the view of the ball and club head by a properly positioned golfer when the club head is properly positioned. A properly positioned golfer is one whose head of the golfer is directly over the ball 34. A properly positioned club is one in which the striking face 12 is substantially perpendicular to the intended line of putt.

The first and second markings 26 and 28 are spaced apart by a distance substantially equal to the diameter of the club shaft 18 at the region of the club shaft that will be seen by the golfer when the markings are focused upon during a putt. Thus, in the technically correct golfer-to-putter-to-ball arrangement of FIG. 4, the inner edges of the first and second markings are in an overlapping relationship with the exterior of the club shaft. However, this is not critical. Alternatively, the first and second markings may be closer together, and the outer edges of the first and second markings may be used to determine proper alignment. The important aspect of the markings is that a parallel relationship between the markings and the shaft is perceived by a golfer when the golfer and the club are correctly positioned.

In the preferred embodiment, the center marking 30 is a distinctive color that is readily recognized. For example, the center marking may be red, signifying that an adjustment should be made before proceeding with the putt. When measured in a direction perpendicular to the striking face 12 of the head 10, the distance across the center marking should not exceed the diameter of the club shaft 18. Thus, the center marking should be completely screened by the club shaft when the golfer and club are correctly positioned for a putt. Preferably, the center marking is smaller than the diameter of the portion of the club shaft 18 shown in FIG. 4, since stereoscopic vision must be taken into account to ensure proper screening of the marking. While the center marking is shown as being circular, a four-sided marking may be preferable, since it is more easily seen. While not illustrated in the drawings, the center marking may be divided. The portions of the center marking closest to the first and second markings 26 and 28 are the portions of significance with respect to the invention.

In operation, a golfer will position his or her feet as desired, typically perpendicular to an intended line of putt. The head of the player should be directly over the golf ball 34 and the striking face 12 of the putter head 10 should be perpendicular to the intended line of putt. If the golfer is properly positioned but the striking face 12 is at an angle other than perpendicular to the line of putt, the club shaft 18 will screen a portion of either the first or second marking 26 and 28, a segment of the center marking 30 will be visible. For example, if the putter head 10 is rotated in a counterclockwise direction with respect to FIG. 4, a golfer who has not otherwise moved will not see the entirety of the second marking 28, but the left side of the center marking 30 will be visible below the club shaft 18. On the other hand, if the golfer's head remains stationary and the putter head 10 is moved in a clockwise direction from the position shown in FIG. 4, the first marking 26 will be partially screened by the club shaft 18 and the right side of the center marking will be visible below the club shaft. It is only when the player looks at the shaft and sees both of the linear markings 26 and 28 in the position shown in FIG. 4 that the golfer can be reasonably assured that the striking face 12 is perpendicular to the line of putt.

In addition to having the striking face 12 perpendicular to the intended path of ball travel, a properly executed putt requires that the head and eyes of the player be positioned directly over the ball 34. If the player's head is too far forward, the left segment of the center marking 30 will be visible from under the club shaft 18. Moreover, a portion of the second linear marking 28 will be screened by the club shaft. On the other hand, a player positioned too far behind the ball will see the right side of the center marking and will see only a limited portion, at best, of the first marking 26. Based upon the ability or inability to see the markings, a golfer makes an adjustment to properly position his or her head.

While the invention has been described with reference to the golf putter of FIGS. 1–4, persons skilled in the art will recognize that the alignment markings may be used with putters of other designs as well.

I claim:

1. A golf putter comprising:

an elongated club shaft having first and second ends, said club shaft being formed in cross section to define a reference dimension along at least a portion of said club shaft that is proximate to said second end; and a putter head connected to said second end of said club shaft at a junction, said putter head having a striking surface and having a heel portion and a toe portion on opposed sides of said junction, said heel portion having an upper surface having alignment markings thereon, including first and second markings having edges along parallel planes that are generally parallel to said striking surface and that are spaced apart from surface edges of said upper surface, said first and second markings extending on opposed sides of said junction relative to said striking surface and being spaced apart by a distance generally equal to said reference dimension, said putter head further including a proper line of sight wherein said alignment marks have the appearance of being both parallel and aligned with said club shaft, whereby said proper line of sight is attained by a golfer who is properly positioned over a ball to be struck by said golf putter.

2. The golf putter of claim 1 wherein said alignment markings include a center marking on said heel portion, said center marking being between said first and second markings, said center marking having a selected dimension that is perpendicular to said parallel planes, said selected dimension being less than said reference dimension defined by said club shaft, said alignment markings being on an upper surface of said heel portion, said portion of said club shaft that is proximate to said second end being at an acute angle to said upper surface and angling in a direction opposite to said toe portion.

3. The golf putter of claim 1 wherein said alignment markings are entirely contained on said heel portion of said putter head.

4. The golf putter of claim 2 wherein said first and second markings and said center marking are imprints in said upper surface of said heel portion, said upper surface having a forward edge that is proximate to said striking surface, both of said first and second markings being spaced apart from said forward edge.

5. The golf putter of claim 2 wherein said first and second markings and said center marking are raised areas formed on said upper surface of said heel portion, said upper surface having a forward edge that is proximate to said striking surface, both of said first and second markings being spaced apart from said forward edge.

6. The golf putter of claim 2 wherein said center marking is circular.

7. The golf putter of claim 1 wherein said alignment markings are on an upper surface of said heel portion and wherein said club shaft is connected to said putter head such that said club shaft angles over said heel portion at an acute angle to said upper surface.

8. A golf putter comprising:

a putter head having a heel portion and a toe portion, said heel portion having a generally planar upper surface, said putter head having a striking surface;

an elongated club shaft extending from said putter head at an acute angle to said upper surface of said heel portion and in a direction away from said toe portion, said club shaft having a lower region having a maximum cross sectional dimension;

first and second markings on said upper surface of said heel portion in parallel relationship with said direction of extension of said club shaft, said first and second markings being entirely contained on said heel portion, said first and second markings having edges that are spaced apart by a distance slightly greater than said maximum cross sectional dimension, said edges of each first and second markings being visible on opposed sides of said club shaft when said putter head and club shaft are viewed downwardly by a golfer properly positioned to strike a golf ball with said striking surface; and a center marking between said first and second markings on said upper surface, said center marking being positioned to be blocked from view by said club shaft when said putter head and club shaft are viewed downwardly by said golfer properly positioned to strike said golf ball.

9. The golf putter of claim 8 wherein said center marking has a selected dimension perpendicular to said edges of said first and second markings and said lower region defines a circular cross section, said selected dimension being less than a diameter of said circular cross section.

10. The golf putter of claim 9 wherein said center marking is circular and said selected dimension is a diameter.

11. The golf putter of claim 8 where said center marking and first and second markings are printed on said upper surface of said heel portion.

12. The golf putter of claim 8 wherein said center marking and said first and second markings are imprinted into said heel portion.

13. The golf putter of claim 8 wherein said first and second markings are lines that are spaced apart from edges of said upper surface of said heel portion.

14. The golf putter of claim 8 further comprising at least one hole-alignment line extending perpendicular to said striking face.

15. The golf putter of claim 8 wherein said edges of said first and second markings are outer edges, said first and second markings having inner edges that are spaced apart by a distance generally equal to said maximum cross sectional dimension of said lower region of said club shaft.

* * * * *